US006227280B1

(12) United States Patent
Wirth et al.

(10) Patent No.: US 6,227,280 B1
(45) Date of Patent: May 8, 2001

(54) SUNSHADE OF THE TYPE OF A VENETIAN BLIND

(75) Inventors: Harry Wirth; Andreas Gombert; Volker Willwer; Jörg Jungjohann, all of Freiburg (DE)

(73) Assignee: Fraunhofer-Gesellschaft zur Forderung der angewandten Forschung e.V., Munich (DE)

( * ) Notice: Subject to any disclaimer, the term of this patent is extended or adjusted under 35 U.S.C. 154(b) by 0 days.

(21) Appl. No.: 09/319,442

(22) PCT Filed: Dec. 23, 1997

(86) PCT No.: PCT/DE97/03017

§ 371 Date: Aug. 9, 1999

§ 102(e) Date: Aug. 9, 1999

(87) PCT Pub. No.: WO98/29633

PCT Pub. Date: Jul. 9, 1998

(30) Foreign Application Priority Data

Jan. 3, 1997 (DE) ..... 197 00 111

(51) Int. Cl.[7] ..... E06B 9/26
(52) U.S. Cl. ..... 160/166.1 R; 160/236
(58) Field of Search ..... 160/236, 173 R, 160/168.1 R, 176.1 R, 166.1 R; 359/596, 592

(56) References Cited

U.S. PATENT DOCUMENTS 2,103,788 12/1937 Mohrfeld .
2,572,957 * 10/1951 Shaw ..... 160/236 X
4,398,587 8/1983 Boyd .
4,486,073 * 12/1984 Boyd ..... 160/236 X
4,509,825 * 4/1985 Otto et al. ..... 160/236 X
4,773,733 9/1988 Murphy, Jr. et al. .

FOREIGN PATENT DOCUMENTS 44 42 870 A1 3/1996 (DE) .

* cited by examiner

*Primary Examiner*—David M. Purol
(74) *Attorney, Agent, or Firm*—Staas & Halsey LLP

(57) ABSTRACT

A Venetian type sunshade comprising a plurality of parallel lamellae with horizontally extending respective longitudinal axes, which are adapted to be rotated about their respective longitudinal axes using an adjusting mechanism. The lamellae, or a layer applied on the upper side of the lamellae, consists of a material transparent to sunlight. Each lamella has an upper side, a plurality of ribs, and a third face. Each rib has a first face arranged obliquely relative to the upper side of the lamella and adapted to be irradiated by the sun in an approximately vertical direction, and a second face which is arranged flush and at an acute angle of roughly 45° relative to the first flat element. The third face is approximately orthogonal to the second faces. Adjacent ribs define a mutual spacing which permits a low shade irradiation and emission through the first faces when there is approximately perpendicular irradiation of the first flat elements, with the optical connection between the mutual spacing being within the thickness between the upper side of a lamella and the third face.

19 Claims, 3 Drawing Sheets

SUNSHADE OF THE TYPE OF A VENETIAN BLIND

FIELD OF THE INVENTION

The present invention relates to a Venetian blind type sunshade having a plurality of lamellae which are arranged in parallel with each lamella having substantially plane face elements along a respective longitudinal axis wherein each lamella may reflect received sunlight while maintaining a through-view along the horizontal direction.

PRIOR ART

Known sunshades, such as lamellar Venetian blinds made of vinyl or aluminum, do not both afford protection from the direct glare of sunlight inside rooms and allow selective transmission of light for the entry of daylight so that artificial light inside a room may be dispensed with. Moreover, lamellar Venetian blinds, particularly in a condition of completely screening-off, do not allow any possibility of an optical through-view to the outside, which would be desirable to improve the quality of the living and working environment in the rooms thus screened-off.

Generic screening systems are known which disperse sunlight with optically non-transparent materials used for lamellar Venetian blinds and utilize the fact that, with direct solar irradiation on surfaces of buildings or windows, up to 80% of the irradiating light intensity originates from a solar or circumsolar spatial angle. These sunshade systems, which are mainly made of optically transparent materials, have directionally selective transmissive properties and screen-off the light coming from undesired angles, preferably that from the solar spatial angle. However, these systems are substantially optically transparent for light components from other directions. Examples of such sunshade systems are known, for example, from U.S. Pat. No. 631,220, U.S. Pat. No. 3,255,665 and U.S. Pat. No. 737,979.

Because the angle of solar elevation changes steadily in the course of a year, it is necessary either for such directionally selective sunshade systems to be adapted to the actual position of the sun (so-called "active elements"), or for the directionally selective properties to be so designed that they permanently screen-off a very wide range of spatial angles of the sky (so-called "passive elements").

One example of active elements is described in the EP 0 090 830, which shows a sunshade designed in the form of lamellae using a material transparent to light. The plurality of lamellae are parallel to each other, and are each rotatable about their respective longitudinal lamella axes have a plane surface facing the sun, the opposite surface having a prismatic structure preferably consisting of prismatic rods aligned in parallel. For effective protection from the sun, the individual surfaces facing the sun must be aligned approximately perpendicularly to the prevailing incident light so that the light rays incident on the individual lamellae of an optically transparent material are reflected back to the outside by total reflection. Although the known sunshade permits the entry of daylight into the interior of a room, it blocks the through-view considerably because of the necessary orientation perpendicular to the sun.

The aspect ratio A/B, which indicates the ratio of the inter-lamellar spacing A between two adjacent lamellae of the Venetian blind to the lamella width B, serves as a geometric index for lamellar Venetian blinds. FIG. 2 shows a diagram representing, as a percentage, the portion of the area between the lamellar elements which is available for an unrestricted through-view in depending upon the settings of the lamellar elements, as related to the solar elevation angle that varies during the course of a day.

Within FIG. 2, "Ref. View" plots the portion of the area which remains between the prismatic lamellae according to the above-described European publication and which can be seen through in the horizontal direction, in dependence on the position of the sun. It can be seen that, with the sun in a high position, the single lamellar elements must be oriented at a smaller angle, whereby the unrestricted through-view between two adjacent lamellar elements becomes larger than in the case of sun positions having only low elevation. "Ref. View," as shown, is based on an aspect ratio A/B of 1.

Because of the requirement of an orientation of the individual lamellae perpendicular to the incident solar rays, the through-view characteristics become substantially impaired. In order to avoid the disadvantages of an orientation substantially perpendicular to the sun, lamellar structures have been conceived from which the light which is incident obliquely on the lamella surface is also reflected obliquely. Such arrangements are evident from the documents DE 44 42 870 A1 and DE 44 44 509 A1. The lamellae described there for precisely controlling the direct solar irradiation have a sun-facing saw-tooth-like structure which, however, is coated with a metal coating. However, the disadvantage of these known sunshade systems is the strong heating of the metal surfaces, because they absorb between 5 and 15% of the incident energy, depending on the actual design. Moreover, the individual lamellar elements are optically non-transparent because of the metal coating.

Sunshades of large area having a lamella-like structured surface are known, for example, from the publications GB 2 220 025 A and GB 2 170 256 A . Both cases involve facade coverings transparent to sunlight, which are preferably suitable for greenhouses, and deflect the sunlight at a desired angle of incidence into the interior of a greenhouse. Although total reflections occur with a suitable optical arrangement of the optically active surfaces of the sunshades, in the case of FIGS. 2 and 3 of GB 2 170 256, the light is not reflected back in the same direction from which the light is incident on the sunshade. Glare effects in the environment are unavoidable.

BRIEF DESCRIPTION OF THE INVENTION

An object of the invention is to provide a Venetian blind system that substantially allows through-view while substantially reducing glare.

A further object of the invention is further developing a Venetian blind type sunshade having a plurality of lamellae which have substantially plane face elements of elongated configuration, wherein each lamella may be irradiated by the sun at such an angle that a through-view along the horizontal direction is substantially retained, the development being that the characteristics of the view through the sunshade are substantially unimpaired or only slightly impaired while any dazzling or glare effects caused by the sunlight directly incident into the interior of a room are prevented. In particular, the sunshade should not display any self-heating and should be made of an optically transparent material.

According to the invention, a Venetian blind type sunshade having a plurality of lamellae that are arranged in parallel with horizontally extending longitudinal axes and which are rotatable about respective longitudinal axes by means of an adjusting mechanism is designed in such manner that each lamella, or a layer coated on the upper side of the lamella, consists of a material transparent to sunlight and has a cross-section, which is composed of the following face elements: (a) first face elements which are disposed obliquely to the upper side of the lamellae and can receives sunlight approximately perpendicularly; (b) second face elements which are disposed flush with and at an acute angle of about 45° to the first face elements; and (c) a third face element which is disposed to be approximately perpendicular to the second face elements.

In particular, adjacent pairs of first and second face elements have a mutual spacing which, when said first face elements are irradiated approximately perpendicularly by sunlight, permits irradiation by and emission of the sunlight via the first elements with little screening. Moreover, the only optical connections permitted across this spacing are within the thickness between the upper surface and the third face.

The orientation of the surfaces of the optical connecting elements parallel to the third face elements ensures that direct sunlight can leave the lamella exclusively via the first face elements. This aspect is important in order that errors of adjustment and other deviations from the ideal ray path do not impair the functioning of the lamella.

The invention is based on the concept of the sunlight being incident on the upper side of the lamella, preferably at an angle of about 40° to 45°, and being reflected back from there by total reflection, preferably in the same direction as that from which the sunlight is incident on the sunshade. In this way, an effective sun shading can be achieved at relatively small inclinations of the individual lamellae about their longitudinal axes. This results in the portions of the area available for an unrestricted horizontal through-view between the individual lamellae being very large in comparison with conventional Venetian blinds which require a normal, i.e. perpendicular, orientation of the lamellae to the sun.

Additional objects and advantages of the invention will be set forth in part in the description which follows and, in part, will be obvious from the description, or may be learned by practice of the invention.

BRIEF DESCRIPTION OF THE DRAWINGS

These and other objects and advantages of the invention will become apparent and more readily appreciated from the following description of the preferred embodiments, taken in conjunction with the accompanying drawings of which.

DESCRIPTION OF THE PREFERRED EMBODIMENTS

Figure 1:
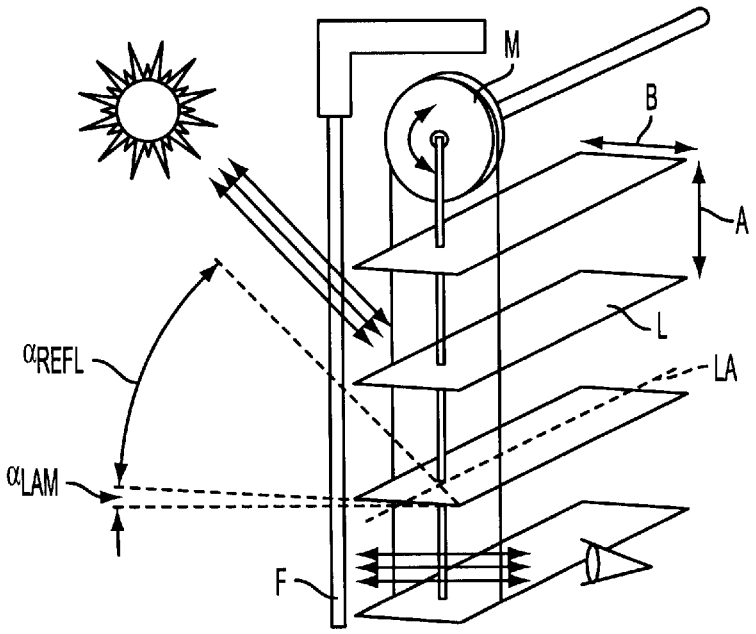
FIG. 1 is a Venetian blind arrangement with an adjusting mechanism.
Figure 2:
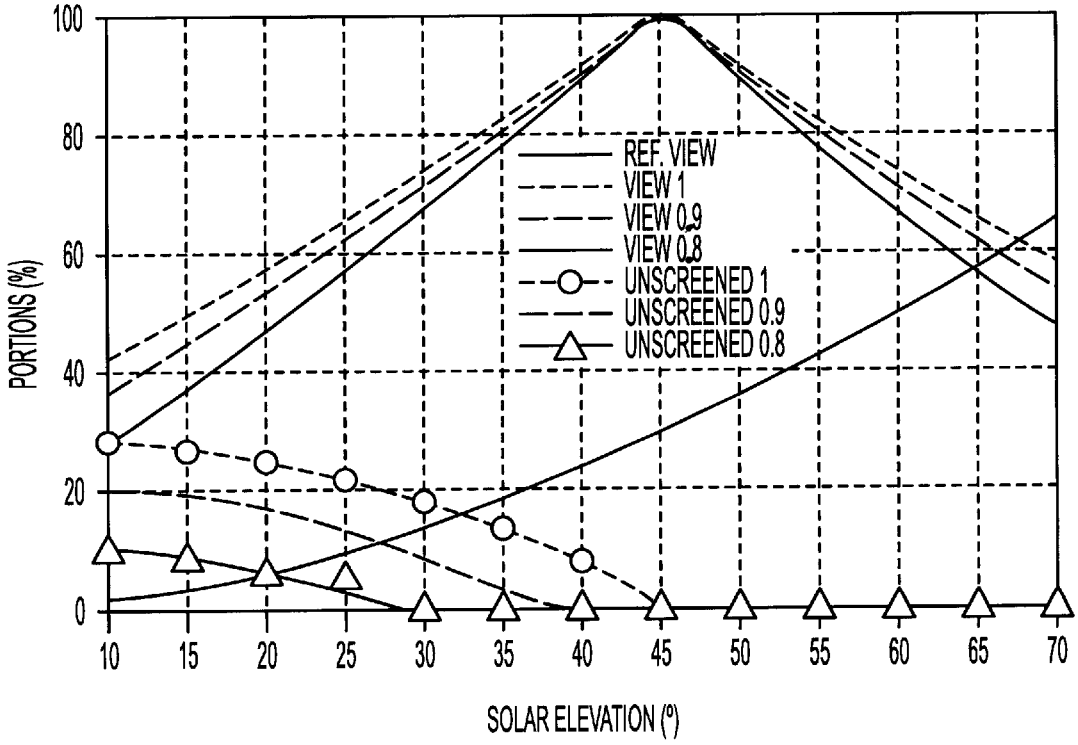
FIG. 2 is a diagrammatic illustration with variable aspect ratios.

Reference will now made in detail to the present preferred embodiments of the present invention, examples of which are illustrated in the accompanying drawings, wherein like reference numerals refer to the like elements throughout. The embodiments are described below in order to explain the present invention by referring to the figures.

The sunshade illustrated in FIG. 1 has lamellae L, the horizontal orientations of which can be adjusted via a drive mechanism M, each having a width B and a mutual spacing A. In the example shown, the lamella arrangement is mounted behind a window F in order to prevent light rays which directly come from the sun from entering the interior of the room. In order to improve the through-view characteristics of the sunshade, i.e. to maximize the portion of the areas enabling a through-view between the lamellae L, the surfaces of the lamellae are of such nature that solar rays incident on the surfaces preferably at an angle of 40° to 55° with respect to the surface plane are reflected back within an angular range $\alpha_{Refl}$. The planes of the lamellae can be moved around their respective longitudinal axes LA through an angle $\alpha_{Laml}$. The sunlight incident on the lamella surfaces is reflected back preferably in the same direction as that from which it is incident on the surface.

Preferably the front lamella edges facing the solar irradiation are provided with a reflecting coating on their undersides, so that back reflected light rays which are reflected at a steeper angle of reflection and are thus incident on the underside of the next higher lamella may be deflected to the outside by the reflecting layer.

Figure 3:
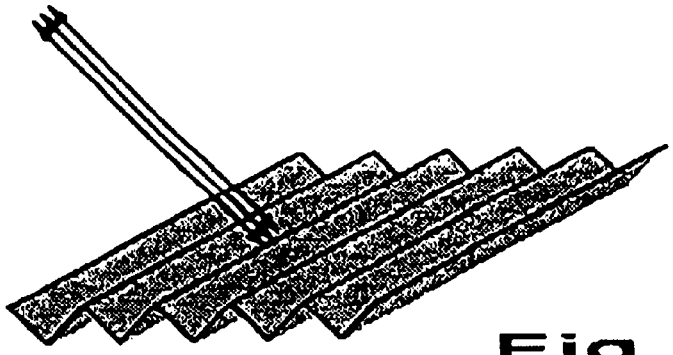
FIG. 3 is a perspective illustration of a saw-tooth structure.

A furrowed or saw-tooth surface having face portions oriented substantially perpendicularly to the incident light rays basically serves as a suitable surface structure which is either additionally applied onto the surface of each lamella as a structured layer of transparent material, for example a transparent film, or constituted by the lamella itself. FIG. 3 shows, as an example of a suitably reflecting surface structure, a substantially furrowed surface having face portions which are oriented perpendicularly to the incidence of light and at which the incident light is reflected back in the same direction as that from which it is incident on the surface.

Figure 4:
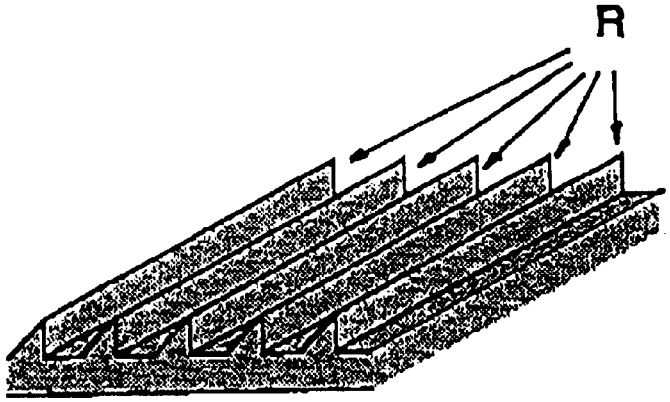
FIG. 4 is a perspective illustration of a lamella surface structure according to the invention.

FIG. 4 illustrates an embodiment of a lamella layer, or only an upper part of a complete lamella, according to an embodiment. The surface facing the sun has a succession of ribs R extending in parallel and having cross-sections corresponding to a saw-tooth structure. The underside of the lamella, by contrast, is formed to be plane.

Figure 5:
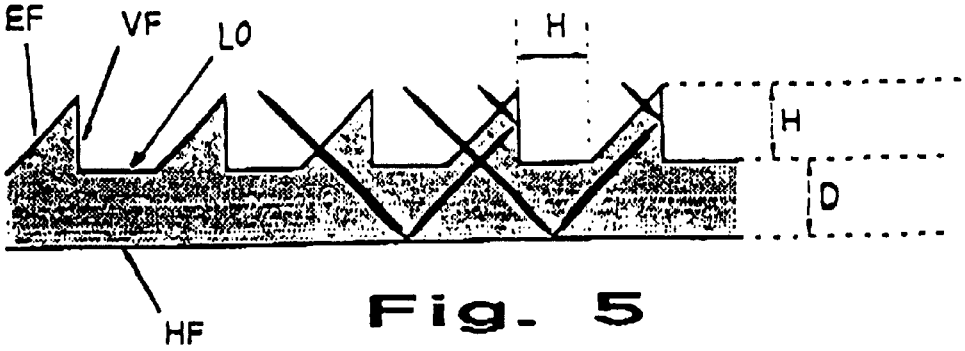
FIG. 5 is a cross-sectional view through a saw-tooth structure according to the invention.

FIG. 5 illustrates a cross-section of the lamella surface structure according to an embodiment. The first face EF, also referred to in the following as a receiving face, is inclined to the upper side LO of the lamella, and can be substantially oriented to be normal to the sun by the lamella as a whole being oriented according to the sun. The solar rays penetrating the receiving face EF substantially perpendicularly are incident on a third face HF extending parallel to the lamella plane, from which they are totally reflected. The totally reflected ray components subsequently arrive at a second face VF, oriented to be substantially perpendicular to the upper side LO of the lamella, from which they are totally reflected a second time, whereby the light rays deflected in this manner substantially travel in a direction opposite to that from which they were incident on the receiving face EF. The light rays deflected or back-reflected by the lamellar structure illustrated in FIG. 5 emerge into free space substantially via the receiving face EF.

Because of the planar arrangement of the lamellae, it is necessary, geometrically, to dispose a plurality of successive parallel ribs having a substantially saw-tooth structure across the width B of the lamella L. However, due to the structural height H of the individual structural elements and their mutual spacing, which preferably should be of the same order of magnitude H, problems will arise because successive elements mutually screen-off each other. The cause of the screening is both the finite spatial angle of the sun and the practically unavoidable error in directing the lamellae with respect to the sun. Thus, either the receiving faces EF of adjacent structural elements will partially screen-off each other, or else light will be incident between the sections.

The angular range within which total reflection occurs will basically depend on the refractive index of either the optically transparent material of the layer applied to the lamella or the lamella itself. For polycarbonate having a refractive index n=1.59 the aperture angle for total reflection is 9.6°:

$$\alpha_{in} \leq n\cdot(45°-\alpha_r)=n\cdot 45°-\arcsin 1/n=9.6°.$$

The angle computed as above is measured with respect to the direction normal to the receiving face EF. In order to avoid possible losses within the optically transparent medium, the solid layer thickness D according to FIG. 5 corresponds to an integral multiple of the structural height H. If the dimensioning deviates from the ideal case, additional and actually unnecessary total reflections will occur within the solid layer. Moreover, the layer thickness D can be reduced to zero whereby adjacent faces EF and VF will not be optically coupled via connecting webs. In this embodiment, the light incident via a receiving face EF will also be reflected back via this same face by total reflection, eliminating the screening-off problems indicated above.

Figure 6:
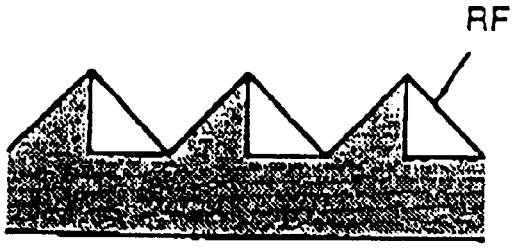
FIG. 6 is the example of embodiment according to FIG. 5 with a reflecting layer.

FIG. 6 illustrates an additional embodiment which provides an additional reflecting face RF between each perpendicularly extending face VF and the corresponding adjacent receiving face EF. These reflecting faces prevent light having an angle of incidence at variance from the ideal case from being incident on the upper surface LO between two successive receiving faces EF, and also back-reflected light components which travel at too small an angle from being incident on the perpendicular face VF on the rear side of the preceding saw-tooth element and thus leading to undesired reflections and glare.

Figure 7:
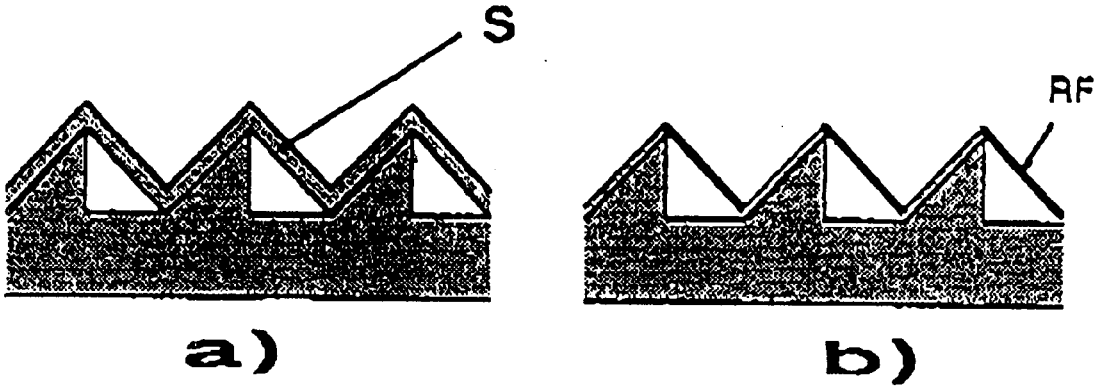
FIGS. 7*a,b* are examples of embodiments according to FIG. 5 with additional reflecting layers.

Two additional embodiments are shown in FIG. 7*a* and 7*b* for realization of the reflecting faces RF: a solid modification according to the embodiment of FIG. 7*a*, and a solid layer modification according to the embodiment of FIG. 7*b*.

The solid embodiment according to FIG. 7*a* provides a cohesive layer S which covers the complete saw-tooth structure and consists of an optically transparent material and possesses total reflection characteristics. Light which is incident steeply on the lamella surface and which without an additional layer S would be incident on the upper surface LO between adjacent elements is now guided onto the receiving face. In addition, EF of the rear adjacent rib light emitted from the receiving face EF that would otherwise be incident on the preceding element because of its low angle of emergence is led over this element using the cohesive layers. An optical contact between the additional layer S and the reflecting structure should not be established, because then undesired reflections would favor dazzling effects. The layer thickness of the additional layer S affects the angular tolerance within which the above-described possibilities of error may be obviated. An expedient limit is represented by the aperture of the element for total reflection, which is approximately 10°. According to the following formula:

$$d_A=2\cdot H\cdot\tan\beta/n=0.16H,$$

the recommended minimum thickness of the additional layer S should be 0.16·H.

As an alternative to the solid design of the layer according to the embodiment of FIG. 7*a*, the embodiment according to FIG. 7*b* provides a thin coated layer on the structural elements, wherein the layer thickness dA may be chosen to be arbitrarily small. Only the connections between successive perpendicular layers and receiving layers should be coated with a reflecting layer.

As far as the individual lamellae are concerned, the above screening-off problems can be overcome by means of one of the two above possibilities. For significant deviations of the lamella orientations from an ideal orientation, in particular when the lamella is positioned at too small an angle to the sun, a portion of the reflected light will be incident on the next higher lamella. Precautions against this may be taken by applying a reflecting coating to the underside of the lamella, to prevent the reflected light from penetrating the lamella and creating undesired optical contact within the lamella that would impair the total reflection characteristics.

The manufacture of a Venetian blind type sunshade according to the invention is basically known, using the known means for section fabrication from transparent polymers by a continuous process such as extrusion processes, or using individual construction processes such as die stamping processes. For the manufacture of a complete lamella according to the example of embodiment of FIG. 4 from transparent material such ase polycarbonate, extrusion or die stamping processes are known and available.

Figure 8:
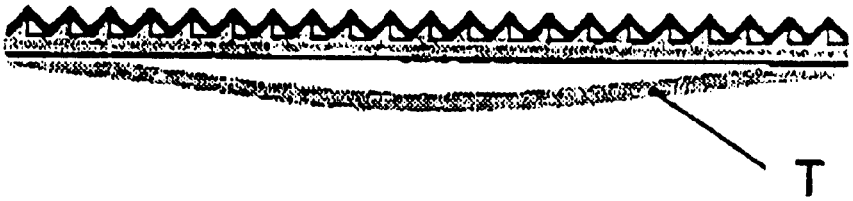
FIG. 8 is a Venetian blind lamella with an additional reflecting layer.

A second possibility of manufacturing the sunshade according to the invention consists of die stamping a film of plastic material, such as polycarbonate, and attaching it to a lamella. FIG. 8 shows a n embodiment of a lamella L which is curved to add structural strength on which the reflecting film layer has been attached by means of adhesive bonding to the edge regions so as to be curved as little as possible. In the case of an elastic film, the Venetian blind can also be raised and stacked.

If for reasons of structural strength a slight curvature of the lamella around its axis is desired, the profile may be adapted so that, despite the curvature of the reflecting layer, an optimal light deflection is achieved across the entire width of the lamella. An example of such an embodiment has the orientations of the perpendicular faces VF increasingly inclined away from their perpendicular orientation along the direction from the front to the rear edge of the lamella.

The lamellae may be made preferably of a transparent material, however, aluminum lamellae as supports have the additional advantage that the lamella underside automatically has reflecting properties.

Although a few preferred embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A Venetian blind having a plurality of parallel lamellae which extend horizontally, each lamella comprising:

an upper side which is of a material transparent to light;

a succession of ribs on said upper side and extending along parallel to the respective longitudinal axis of the lamella, wherein each said rib further comprises a first face which is inclined relative to said upper side and which receives light approximately perpendicularly, and a second face abutting the first face and approximately perpendicular to said upper side; and a third face below and approximately perpendicular to the second faces;

wherein a height of said succession of ribs above said upper side and a thickness between said upper side and said third face is such that light received by said succession of ribs penetrates the first faces, is received by said third face to be reflected by said third face, and is received by the second faces to be reflected out of the lamella through the receiving first faces.

2. The Venetian blind according to claim 1, wherein the thickness is an integral multiple of the height.

3. The Venetian blind according to claim 1, wherein the first and second faces of each said rib are slightly curved.

4. The Venetian blind according to claim 1, wherein each said rib further comprises a fourth face which is disposed between adjacent ribs and is reflective, wherein the fourth faces prevent light received between adjacent ribs from being incident on said upper side between adjacent ribs, and prevent light which leaves the lamella through the first faces from being incident on the second faces of adjacent ribs.

5. The Venetian blind according to claim 1, further comprising a layer of optically transparent material wherein the layer of optically transparent material covers and follows the contour of said upper side and said succession of ribs without materially interfering with the total reflection characteristics of said succession of ribs.

6. The Venetian blind according to claim 1, wherein each lamella has an underside which has a reflective a portion wherein the reflective portion reflects light received by the underside without optically interfering with the total reflection characteristics of said succession of ribs and said third face.

7. A Venetian blind having a plurality of lamellae, with each lamella having a surface structure, comprising:

an upper side; and a plurality of reflection elements on said upper side;

wherein said plurality of reflection elements use internal reflections to reflect away received light to substantially reduce glare while substantially permitting through-view through said plurality of lamellae along a horizontal direction, and wherein each pair of adjacent reflective elements defines a mutual spacing between the adjacent reflective elements, wherein the mutual spacing is approximately the equal to the height of the adjacent reflective elements above the upper side, and the thickness of the adjacent reflective elements below said upper side is an integral multiple of the height.

8. The Venetian blind of claim 7, where each said reflection element further comprises a transmission surface which receives light into the surface structure, and transmits internally reflected light away from the surface structure, and reflection surfaces which receive light from the transmission surface, and provide internally reflected light to one of a plurality of transmission surfaces of the plurality of said reflection elements.

9. The Venetian blind of claim 8, wherein each transmission surface transmits internally reflected light corresponding to the light received by a same transmission surface.

10. The Venetian blind of claim 7, wherein the lamella further comprise an underside which further comprises a reflective portion.

11. The Venetian blind of claim 7, wherein the surface structure further comprises a plurality of intermediate reflective surfaces wherein each said intermediate reflective surface is disposed between adjacent reflective elements wherein each said intermediate reflective surface reflects both light incident to said upper side between said adjacent reflective elements and internally reflected light received from one of said plurality of reflective elements incident to said intermediate reflective surface without causing substantial glare.

12. A Venetian blind having a plurality of lamellae, with each lamella having a surface structure, comprising:

an upper side;

a plurality of reflection elements on said upper side; and an optically transparent coatings, wherein said plurality of reflection elements use internal reflections to reflect away received light to substantially reduce glare while substantially permitting through-view through said plurality of lamellae along a horizontal direction, the surface structure further comprises a plurality of intermediate reflective surfaces wherein each said intermediate reflective surface is disposed between adjacent reflective elements wherein each said intermediate reflective surface reflects both light incident to said upper side between said adjacent reflective elements and internally reflected light received from one of said plurality of reflective elements incident to said intermediate reflective surface without causing substantial glare, and said optically transparent coating which covers the surface structure wherein said optically transparent coating guides the light incident to said intermediate reflective surface onto one of the adjacent reflective elements, and leads internally-reflected light received from one of said plurality of reflective elements incident to said intermediate reflective surface over one of the adjacent reflective elements.

13. A Venetian blind having a plurality of lamellae, with each lamella having a surface structure, comprising:

an upper side;

a plurality of reflection elements on said upper side; and a coating, wherein said plurality of reflection elements use internal reflections to reflect away received light to substantially reduce glare while substantially permitting through-view through said plurality of lamellae along a horizontal direction, the surface structure further comprises a plurality of intermediate reflective surfaces wherein each said intermediate reflective surface is disposed between adjacent reflective elements wherein each said intermediate reflective surface reflects both light incident to said upper side between said adjacent reflective elements and internally reflected light received from one of said plurality of reflective elements incident to said intermediate reflective surface without causing substantial glare, and said coating which covers each said intermediate reflective surface wherein said coating guides the light incident to said intermediate reflective surface onto one of the adjacent reflective elements, and leads internally-reflected light received from one of said plurality of reflective elements incident to said intermediate reflective surface over one of the adjacent reflective elements.

14. A Venetian blind comprising:

a plurality of parallel lamellae which extend horizontally having respective longitudinal axes, each said lamella comprising an upper side which is of a material transparent to light, a succession of parallel ribs on said upper side and extending along parallel to the respective longitudinal axis of said lamella, wherein each said rib further comprises a first face which is inclined relative to the upper side and which receives light approximately perpendicularly, and a second face abutting the first face and approximately perpendicular to the upper side, and a third face below and approximately perpendicular to the second faces; and a drive mechanism which orients said plurality of parallel lamella about the respective longitudinal axes in order to have the first face receive light approximately perpendicularly;

wherein a height of said succession of ribs above the upper side and a thickness between the upper side and the third face is such that light received by the succession of ribs penetrates the first faces, is received by the third face to be reflected by the third face, and is received by the second faces to be reflected out of said lamella through the receiving first faces.

15. The Venetian blind according to claim 14, wherein the thickness is an integral multiple of the height.

16. The Venetian blind according to claim 14, wherein the first and second faces of each said rib are slightly curved.

17. The Venetian blind according to claim 14, wherein each rib further comprises a fourth face which is disposed between adjacent ribs and is reflective, wherein the fourth faces prevent light received between adjacent ribs from being incident on the upper side between adjacent ribs, and prevent light which leaves said lamella through the first faces from being incident on second faces of adjacent ribs.

18. The Venetian blind according to claim 14, further comprising a layer of optically transparent material wherein the layer of optically transparent material covers and follows the contour of the succession of ribs and the upper side and does not materially interfere with the total reflection characteristics of the succession of ribs.

19. The Venetian blind according to claim 14, wherein each said lamella has an underside further comprising a reflective portion wherein the reflective portion prevents light received by the underside from optically interfering with the total reflection characteristics of the succession of ribs and the third face.

* * * * *